US010605555B1

(12) United States Patent
Shaffer et al.

(10) Patent No.: US 10,605,555 B1
(45) Date of Patent: Mar. 31, 2020

(54) TRIGGER ASSEMBLY

(71) Applicant: Hunter's Manufacturing Company, Inc., Suffield, OH (US)

(72) Inventors: Michael Shaffer, Mogadore, OH (US); Richard Bednar, Monroe Falls, OH (US); Gary Smith, Jr., East Canton, OH (US)

(73) Assignee: Hunter's Manufacturing Company, Inc., Suffield, OH (US)

( * ) Notice: Subject to any disclaimer, the term of this patent is extended or adjusted under 35 U.S.C. 154(b) by 0 days.

(21) Appl. No.: 16/220,083

(22) Filed: Dec. 14, 2018

(51) Int. Cl.
*F41B 5/12* (2006.01)
*F41B 5/14* (2006.01)
*F41A 19/10* (2006.01)

(52) U.S. Cl.
CPC ..... *F41A 19/10* (2013.01); *F41B 5/12* (2013.01); *F41B 5/1469* (2013.01)

(58) Field of Classification Search
CPC ..... F41B 5/12; F41B 5/123; F41B 5/1469; F41A 19/10
USPC ..... 124/25, 31, 35.1
See application file for complete search history.

(56) References Cited

U.S. PATENT DOCUMENTS 2,092,361 A 9/1937 Shim
3,043,287 A 7/1962 Nelson
3,561,419 A 2/1971 Cucuzza, Sr.
3,670,711 A 6/1972 Firestone
3,739,765 A 6/1973 Moore
4,192,281 A * 3/1980 King ..... F41B 5/1469 124/25
4,246,883 A 1/1981 Ash
4,593,675 A 6/1986 Waiser
4,603,676 A 8/1986 Luoma
4,649,892 A 3/1987 Bozek
4,662,345 A 5/1987 Stephens
4,665,885 A 5/1987 Glomski et al.
4,719,897 A 1/1988 Gaudreau
4,721,092 A 1/1988 Waiser
(Continued)

OTHER PUBLICATIONS

A Guide to the Crossbow, by W.F. Paterson, published by the Society of Archer-Antiquaries, 1990.
(Continued)

*Primary Examiner* — Alexander R Niconovich
(74) *Attorney, Agent, or Firm* — Emerson Thomson Bennett

(57) ABSTRACT

Provided is a crossbow trigger apparatus comprising a housing, a first lever operationally engaged with the housing to pivot about a first pivot axis; a second lever operationally engaged with the housing to pivot about a second pivot axis between an actuated orientation and an unactuated orientation; a third lever operationally engaged with the housing to pivot about a third pivot axis between an actuated orientation and an unactuated orientation; a fourth lever operationally engaged with the housing to pivot about a fourth pivot axis between an actuated orientation and an unactuated orientation wherein the fourth lever comprises a fourth lever catch adapted to selectably engage the second lever to prevent the second lever from operating to move from the unactuated orientation of the second lever to the actuated orientation of the second lever when the fourth lever is in the unactuated orientation of the fourth lever.

5 Claims, 3 Drawing Sheets

(56) References Cited

U.S. PATENT DOCUMENTS 4,942,861 A 7/1990 Bozek
5,115,795 A 5/1992 Farris
5,205,267 A 4/1993 Burdick
5,215,069 A 6/1993 Liu
5,220,906 A 6/1993 Choma
5,243,956 A 9/1993 Luehring
5,433,186 A 7/1995 Corwin
5,437,260 A 8/1995 King
5,445,139 A 8/1995 Bybee
5,553,596 A 9/1996 Bednar
5,598,829 A * 2/1997 Bednar ..... F41A 17/28 124/25
5,649,520 A * 7/1997 Bednar ..... F41B 5/12 124/25
5,678,528 A 10/1997 Hadley
5,987,724 A 11/1999 Kleman
6,095,128 A 8/2000 Bednar
6,286,496 B1 9/2001 Bednar
6,736,123 B1 * 5/2004 Summers ..... F41A 17/46 124/25
6,802,304 B1 * 10/2004 Chang ..... F41B 5/1469 124/25
6,874,491 B2 4/2005 Bednar
6,913,007 B2 7/2005 Bednar
7,100,590 B2 9/2006 Chang
7,588,022 B2 * 9/2009 Chang ..... F41B 5/123 124/25
7,624,725 B1 12/2009 Choma
7,770,567 B1 * 8/2010 Yehle ..... F41A 17/46 124/25
7,784,453 B1 8/2010 Yehle
8,443,790 B2 5/2013 Pestrue
8,499,753 B2 8/2013 Bednar
8,651,094 B2 * 2/2014 Matasic ..... F41B 5/12 124/23.1
8,770,178 B2 * 7/2014 Kempf ..... F41A 19/10 124/25
8,857,420 B2 * 10/2014 Grace ..... F41B 5/123 124/25
8,899,218 B2 * 12/2014 Kempf ..... F41B 5/1469 124/35.1
9,010,308 B1 * 4/2015 Hyde ..... F41B 5/12 124/25
9,255,754 B1 * 2/2016 Kempf ..... F41B 5/12
9,404,705 B2 * 8/2016 Kennedy ..... F41B 5/1469
9,435,605 B2 * 9/2016 McPherson ..... F41A 17/46
9,506,715 B2 * 11/2016 Hughes ..... F41A 19/10
9,523,549 B1 * 12/2016 Hughes ..... F41B 5/12
10,066,894 B1 * 9/2018 Kempf ..... F41A 17/56
10,215,520 B1 * 2/2019 Liu ..... F41B 5/12
10,215,522 B1 * 2/2019 Kempf ..... F41B 5/12
2006/0086346 A1 4/2006 Middleton
2009/0064978 A1 * 3/2009 Matasic ..... F41B 5/12 124/35.1
2010/0170488 A1 * 7/2010 Rasor ..... F41A 11/02 124/25
2017/0131058 A1 * 5/2017 McPherson ..... F41B 5/123

OTHER PUBLICATIONS

European Crossbows, A Survey by Josef Alm, copyrighted by the Trustees of the Royal Armouries and the Arms and Armour Society, 1994.

The Book of the Crossbow, by Ralph Payne-Gallwey, published by Dover Publications, Inc. of New York, 1995.

* cited by examiner

TRIGGER ASSEMBLY

CROSS-REFERENCE TO RELATED APPLICATIONS

N/A

BACKGROUND

The present subject matter is directed to apparatuses and methods regarding crossbows. More specifically the present subject matter is directed to apparatuses and methods for the bowstring retention for, and firing of a crossbow.

Crossbows have been used for many years as a weapon for hunting and fishing, and for target shooting. Crossbows typically comprise a bowstring engaged through set of pulleys to a set of limbs and to a set of power cords. A bowstring is cocked to energize the crossbow and prepare it to fire. Retention of the cocked bowstring is of interest. It is also of interest to provide an interlock to prevent the release of the cocked bowstring without an arrow operationally loaded into the crossbow.

It remains desirable to improve the apparatuses and methods by which the bowstring is retained, de-cocked, and firing of a crossbow.

SUMMARY

Provided is a crossbow trigger apparatus comprising a housing, a first lever operationally engaged with the housing to pivot about a first pivot axis; a second lever operationally engaged with the housing to pivot about a second pivot axis between an actuated orientation and an unactuated orientation; a third lever operationally engaged with the housing to pivot about a third pivot axis between an actuated orientation and an unactuated orientation; a fourth lever operationally engaged with the housing to pivot about a fourth pivot axis between an actuated orientation and an unactuated orientation wherein the fourth lever comprises a fourth lever catch adapted to selectably engage the second lever to prevent the second lever from operating to move from the unactuated orientation of the second lever to the actuated orientation of the second lever when the fourth lever is in the unactuated orientation of the fourth lever.

BRIEF DESCRIPTION OF THE DRAWINGS

The present subject matter may take physical form in certain parts and arrangement of parts, embodiments of which will be described in detail in this specification and illustrated in the accompanying drawings which form a part hereof and wherein.

DEFINITIONS

Figure 1:
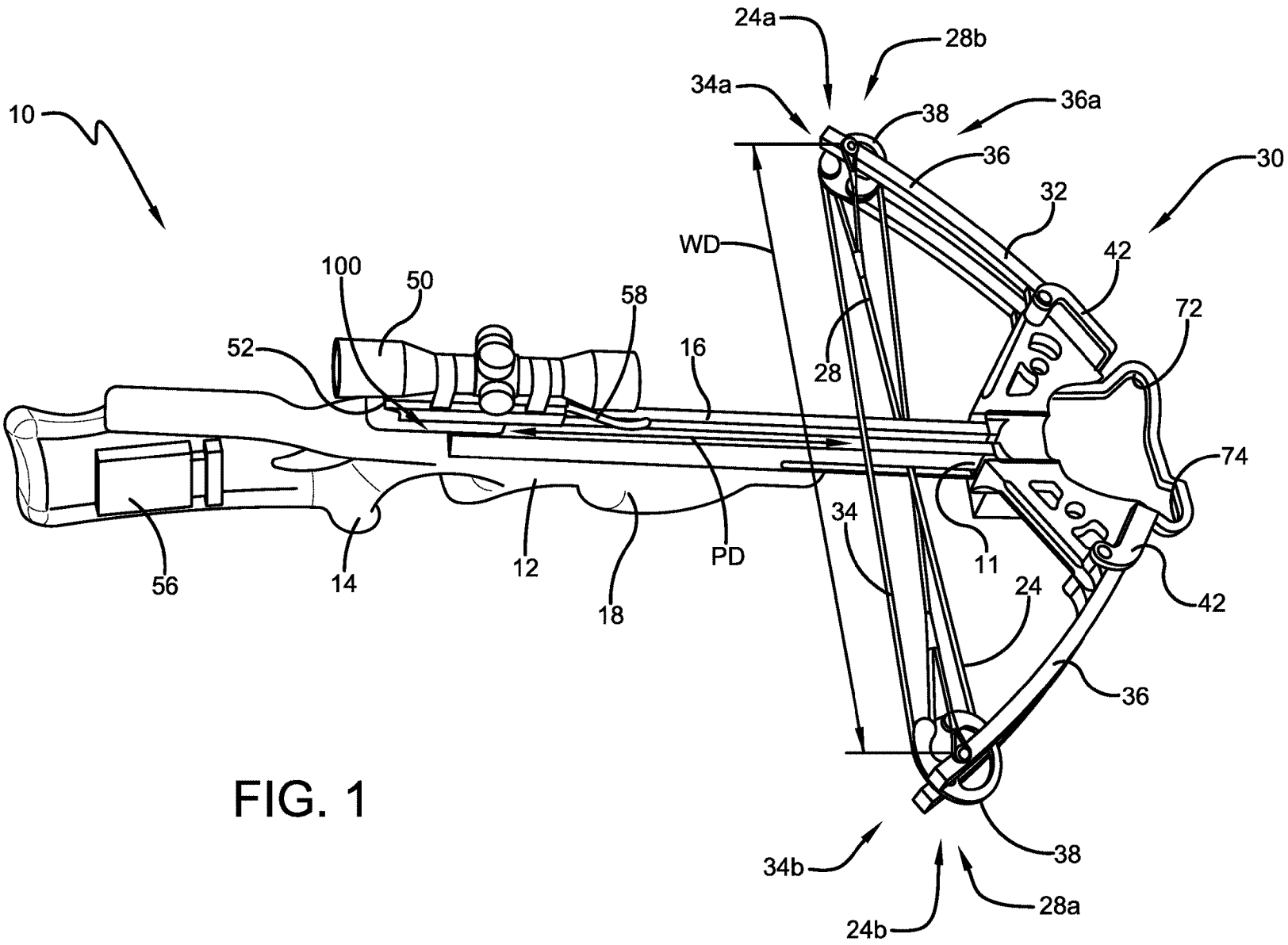
FIG. 1 is a view of one non-limiting embodiment of a crossbow.

The following definitions are controlling for the disclosed subject matter:

"Arrow" means a projectile that is shot with (or launched by) a bow assembly.

"Bow" means a bent, curved, or arched object.

"Bow Assembly" means a weapon comprising a bow and a bowstring that shoots or propels arrows powered by the elasticity of the bow and the drawn bowstring.

"Bowstring" means a string or cable attached to a bow.

"Compound Bow" means a crossbow that has wheels, pulleys or cams at each end of the bow through which the bowstring passes.

"Crossbow" means a weapon comprising a bow assembly and a trigger mechanism both mounted to a main beam.

"Draw Weight" means the amount of force required to draw or pull the bowstring on a crossbow into a cocked condition.

"Main Beam" means the longitudinal structural member of a weapon used to support the trigger mechanism and often other components as well. For crossbows, the main beam also supports the bow assembly. The main beam often comprises a stock member, held by the person using the weapon, and a barrel, used to guide the projectile being shot or fired by the weapon.

"Power Stroke" means the linear distance that the bowstring is moved between the uncocked condition and the cocked condition.

"Trigger Apparatus" means the portion of a weapon that shoots, fires or releases the projectile of a weapon. As applied to crossbows, trigger apparatus means any device that holds the bowstring of a crossbow in the drawn or cocked condition and which can thereafter be operated to release the bowstring out of the drawn condition to shoot an arrow.

"Weapon" means any device that can be used in fighting or hunting that shoots or fires a projectile including bow assemblies and crossbows.

DETAILED DESCRIPTION

Referring now to the drawing wherein the showings are for purposes of illustrating embodiments of the present subject matter only and not for purposes of limiting the same, and wherein like reference numerals are understood to refer to like components, provided are crossbow components and a method of using crossbow components.

FIG. 1 shows a crossbow 10. While the crossbow 10 shown uses a compound bow, it should be understood that this invention will work well with any type of crossbow chosen with sound judgment by a person of ordinary skill in the art.

The crossbow 10 has a main beam 12 having a distal end 11. The main beam 12 may include a stock member 14, and a barrel 16. The main beam 12 may be made by assembling the stock member 14 and the barrel 16 together as separate components or, in another embodiment, the main beam 12 may be made as one piece. A handgrip 18 may be mounted to the main beam 12 in any conventional manner chosen with sound judgment by a person of ordinary skill in the art. A trigger apparatus 100 suitable for shooting an arrow is mounted to the main beam 12 in any suitable manner. The crossbow 10 also includes a bow assembly 30 adapted to propel an associated arrow and having a bow 32 and a bowstring 34. The bowstring 34 may have a first end of the bowstring 34*a* and a second end of the bowstring 34*b*. The bow 32 may include a set of limbs 36, 36 that receive the bowstring 34 in any conventional manner chosen with sound judgment by a person of ordinary skill in the art. For the embodiment shown, a pair of wheels, pulleys, or cams 38, 38 mounted to the limbs 36, 36 receive the bowstring 34 in an operational manner. In each of the non-limiting embodiments, the set of limbs has a first side 36*a* and a second side 36*b* opposite the first side 36*a* with first side 36*a* being operationally engaged with a first cam 38 and second side 36*b* being operationally engaged with a second cam 38. The bow may include a first power cord 24 having a first end 24*a* and a second end 24*b*. The bow may include a second power cord 28 having a first end 28*a* and a second end 28*b*. The bow may also include a riser 40. The riser 40 may comprise a set of limb pockets 42, 42 adapted to receive the limbs 36, 36, as shown in FIG. 1.

Without limitations, other crossbow components may be optionally used with a crossbow as provided herein. Without limitation, in some non-limiting embodiments, a crossbow 10 shown may include a scope 50 attached to a scope mount 52 that is supported on the main beam 12. Other optional components shown include a cocking unit 56, and arrow holder 58. In certain non-limiting embodiments, the riser 40 may have an opening 72 formed therein defining a foot stirrup 74 adapted for holding and balancing the crossbow by foot.

A crossbow 10 may have a power stroke distance PD. The distance between the pivot axes of the wheels, pulleys, or cams 38, 38 may be some distance WD.

A crossbow may comprise a bow assembly mounted with the bowstring cams rearward of the riser, or mounted with the bowstring cams forward of the riser. A crossbow with the bow assembly mounted with the bowstring cams rearward of the riser is sometimes referred to as a conventional crossbow, while a crossbow with the bow assembly mounted with the bowstring cams forward of the riser is sometimes referred to as a reversed crossbow. The subject matter herein applies to both conventional crossbows and reversed crossbows.

FIG. 1 shows one non-limiting embodiment of a crossbow trigger apparatus 100. The crossbow trigger apparatus 100 shown will work well with any type of crossbow chosen with sound judgment by a person of ordinary skill in the art such as, but not limited to the crossbow shown in FIG. 1.

Figure 2A:
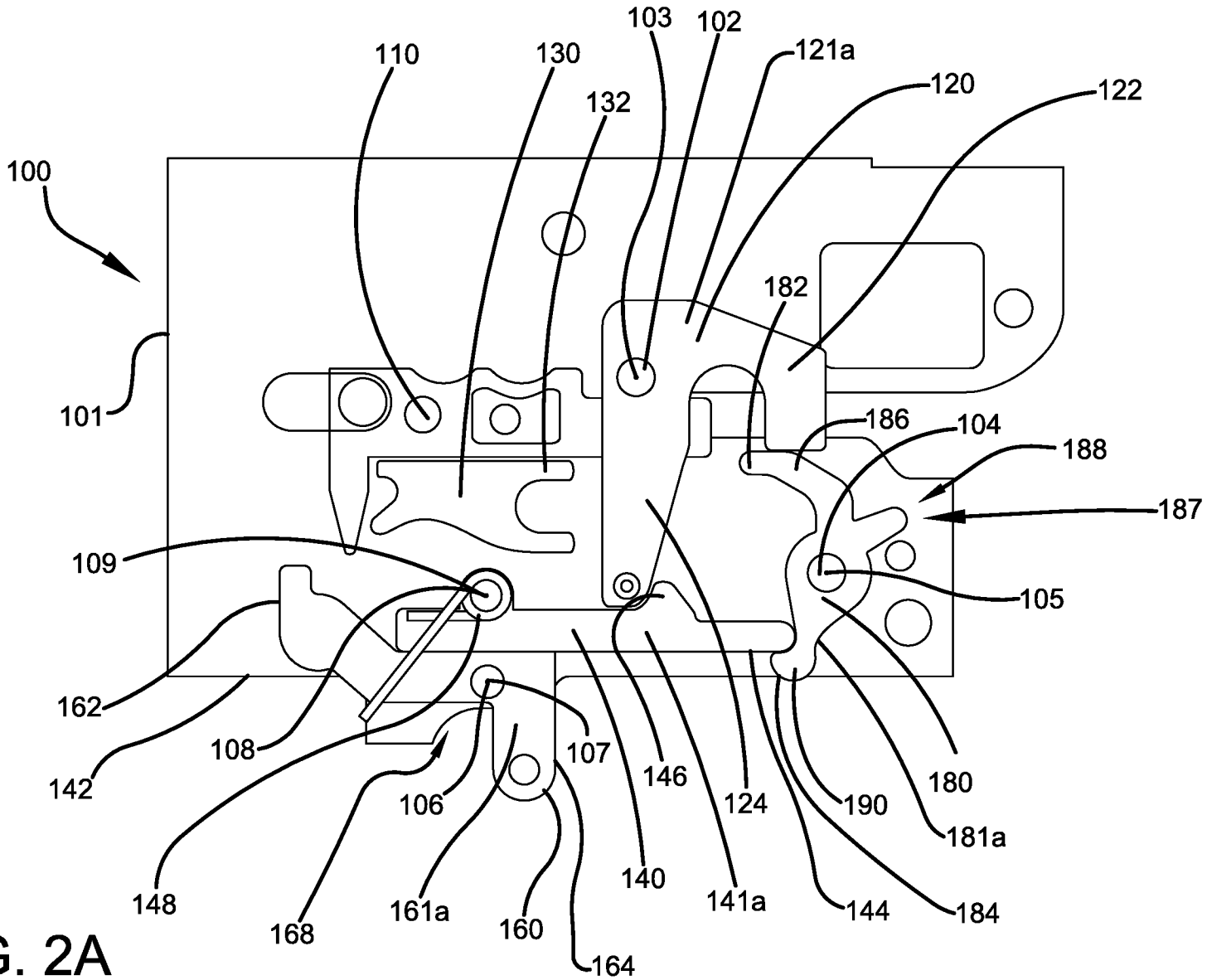
FIG. 2*a* is a view of one non-limiting embodiment of a crossbow trigger apparatus with components in an unactuated configuration.
Figure 2B:
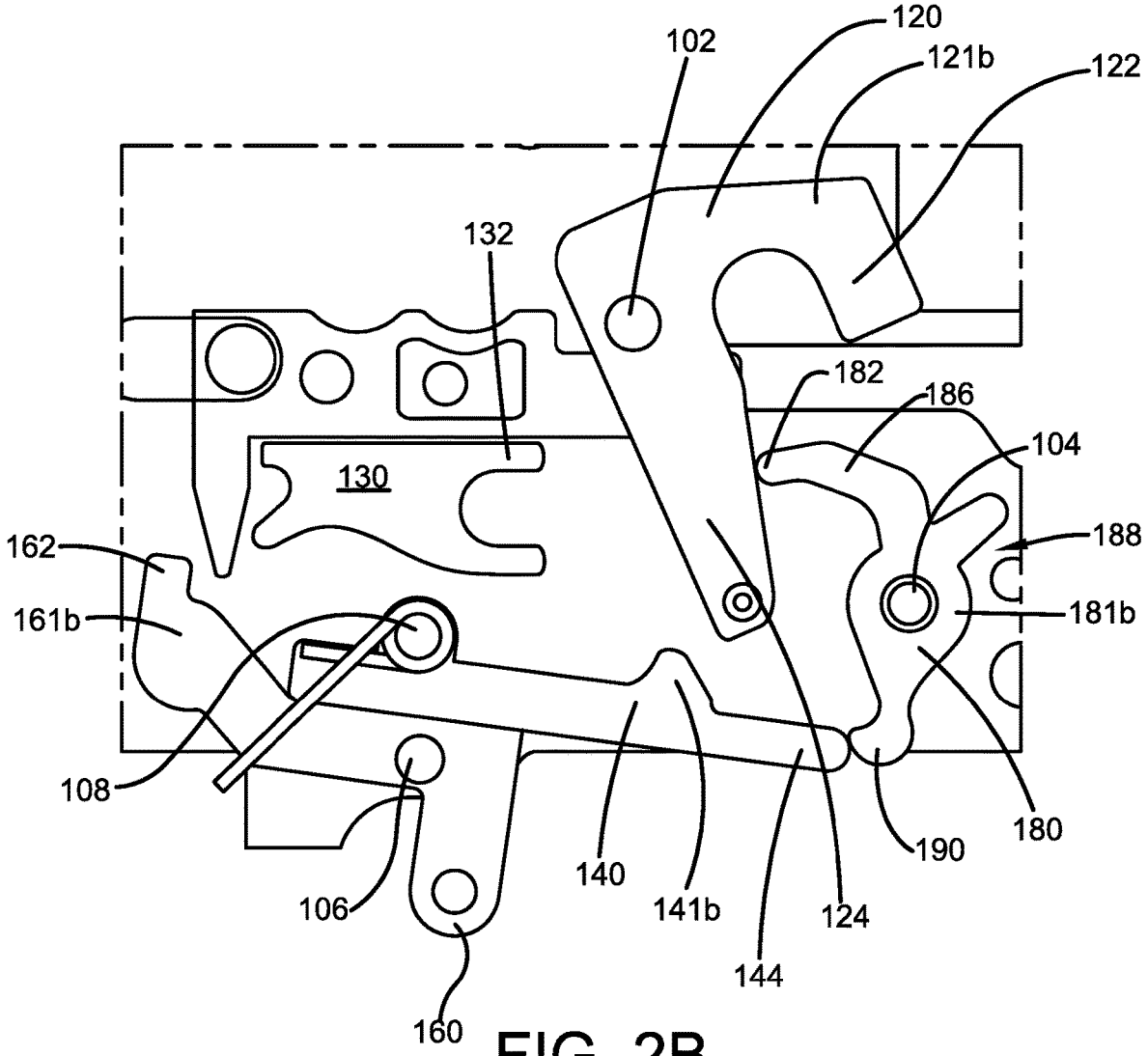
FIG. 2*b* is a view of one non-limiting embodiment of a crossbow trigger apparatus with components in an actuated configuration.

With reference now to FIGS. 2*a* and 2*b*, a trigger apparatus 100 may comprise a substantially rigid housing 101. The housing 101 may provide a frame sufficiently rigid to provide substantially fixed mounting locations for movable components of the trigger apparatus 100. The housing may be composed of steel, steel alloy, aluminum, aluminum alloy, brass, bronze, or other material chosen with good engineering judgment. a trigger lever 160 adapted to be pivotable about a With continued reference to the crossbow shown in FIGS. 2*a* and 2*b*, a trigger apparatus 100 may further comprise: a first lever 160 operationally engaged with the housing 101 to pivot about a first pivot axis 106 between an actuated orientation 161*b* and an unactuated orientation 161*a*; a second lever 140 operationally engaged with the housing 101 to pivot about a second pivot axis 108 between an actuated orientation 141*b* and an unactuated orientation 141*a*; a third lever 120 operationally engaged with the housing 101 to pivot about a third pivot axis 102 between an actuated orientation 121*b* and an unactuated orientation 121*a*; and a fourth lever 180 operationally engaged with the housing 101 to pivot about a fourth pivot axis 104 between an actuated orientation 181*b* and an unactuated orientation 181*a*.

The first pivot axis 106 may be fixed in a first location 107 with respect to the housing, the first lever 160 being elongated to define a first end of the first lever 164 and a second end of the first lever 162 opposite the first end of the first lever 164.

The second pivot axis 108 may be fixed in a second location 109 with respect to the housing 101. The second location 109 may be offset from the first location 108. The second lever 140 may be elongated to define a first end of the second lever 144 and a second end of the second lever 142 opposite the first end of the second lever 144.

The third pivot axis 102 may be fixed in a third location 103 with respect to the housing 101. The third location 103 may be offset from the first location 107, and may be offset from the second location 109. The third lever 120 may be elongated and U-shaped to define a first end of the third lever 124 and a second end of the third lever 122 opposite the first end of the third lever 124. The third lever 124 may be adapted, when in the unactuated orientation 121*a*, to retain an associated cocked bowstring, and when in the actuated orientation 121*b*, to release an associated cocked bowstring. The third lever 120 may be adapted to be rotated from the actuated orientation of the third lever 121*b* to the unactuated orientation of the third lever 121*a* by cocking an associated bowstring.

The fourth pivot axis 104 may be fixed in a fourth location 105 with respect to the housing 101. The fourth location 105 may be offset from the first location 107, may be offset from the second location 109, and may be offset from the third location 103, the fourth lever 180 being elongated to define a first end of the fourth lever 184 and a second end of the fourth lever 182 opposite the first end of the fourth lever 184.

The fourth lever 180 may comprise a fourth lever catch 190 adapted to selectably engage the second lever 140 to prevent the second lever 140 thus engaged from operating to move from the unactuated orientation of the second lever 141*a* to the actuated orientation of the second lever 141*b* when the fourth lever 180 is in the unactuated orientation of the fourth lever 181*a*.

The second lever may comprise a second lever catch 146 adapted to selectably engage the third lever 120, and to prevent the third lever 120 thus engaged from operating to move from the unactuated orientation of the third lever 121*a* to the actuated orientation of the third lever 121*b* when the second lever 140 is in the unactuated orientation of the second lever 141*a*.

The fourth lever 180 may be adapted to be moved from the unactuated orientation of the fourth lever 181*a* to the actuated orientation of the fourth lever 181*b* by an associated arrow being operationally engaged with the crossbow trigger apparatus 100. For example and without limitation, operationally engaging an associated arrow with the crossbow trigger apparatus 100 may trip the fourth lever arrow lobe 186 and thereby move the fourth lever 180 from the unactuated orientation of the fourth lever 181*a* to the actuated orientation of the fourth lever 181*b*. Alternatively or in addition to the fourth arrow lever lobe 186 the fourth lever 180 may comprise a manual decocking lobe 187 adapted to permit an associated user to selectably move the fourth lever 180 from the unactuated orientation of the fourth lever 181*a* to the actuated orientation of the fourth lever 181*b*.

A trigger apparatus may comprise one or more springs operationally engaged with one or more levers to bias the levers therein to a particular orientation. The fourth lever 180 may be engaged with a fourth lever spring 188 that biases the fourth lever 180 to the unactuated orientation of the fourth lever 181*a*. The second lever 140 may be engaged with a second lever spring 148 that biases the second lever 140 to the unactuated orientation of the second lever 141*a*. The first lever 160 may be engaged with a first lever spring 168 that biases the first lever 160 to the unactuated orientation of the first lever 161*a*.

The trigger apparatus 100 may further comprise a safety member 130 movable between a safe position and a fire position wherein, when the safety member 130 is in the safe position it prevents the first lever 160 from operating to move from the unactuated orientation of the first lever 161*a* to the actuated orientation of the first lever 161*b*. The safety member 130 may have a front end 132.

The trigger apparatus 100 may further comprise a slidable safety 110.

Numerous embodiments have been described, hereinabove. It will be apparent to those skilled in the art that the above methods and apparatuses may incorporate changes and modifications without departing from the general scope of the present subject matter. It is intended to include all such modifications and alterations in so far as they come within the scope of the appended claims or the equivalents thereof.

Having thus described the invention, it is now claimed:

What is claimed is:

1. A crossbow trigger apparatus comprising a housing;

a first lever operationally engaged with the housing to pivot about a first pivot axis between an actuated orientation and an unactuated orientation, the first pivot axis being fixed in a first location with respect to the housing, the first lever being elongated to define a first end of the first lever and a second end of the first lever opposite the first end of the first lever;

a second lever operationally engaged with the housing to pivot about a second pivot axis between an actuated orientation and an unactuated orientation, the second pivot axis being fixed in a second location with respect to the housing, the second location being offset from the first location, the second lever being elongated to define a first end of the second lever and a second end of the second lever opposite the first end of the second lever;

a third lever operationally engaged with the housing to pivot about a third pivot axis between an actuated orientation and an unactuated orientation, the third pivot axis being fixed in a third location with respect to the housing, the third location being offset from the first location, and being offset from the second location, the third lever being elongated and U-shaped to define a first end of the third lever and a second end of the third lever opposite the first end of the third lever, the third lever being adapted, when in the unactuated orientation, to retain an associated cocked bowstring, and when in the actuated orientation, to release an associated cocked bowstring;

a fourth lever operationally engaged with the housing to pivot about a fourth pivot axis between an actuated orientation and an unactuated orientation, the fourth pivot axis being fixed in a fourth location with respect to the housing, the fourth location being offset from the first location, being offset from the second location, and being offset from the third location, the fourth lever being elongated to define a first end of the fourth lever and a second end of the fourth lever opposite the first end of the fourth lever;

wherein the fourth lever comprises a fourth lever catch adapted to selectably engage the second lever to prevent the second lever from operating to move from the unactuated orientation of the second lever to the actuated orientation of the second lever when the fourth lever is in the unactuated orientation of the fourth lever;

wherein the second lever comprises a second lever catch adapted to selectably engage the third lever, and to prevent the third lever from operating to move from the unactuated orientation of the third lever to the actuated orientation of the third lever when the second lever is in the unactuated orientation of the second lever; and wherein the fourth lever is adapted to be moved from the unactuated orientation of the fourth lever to the actuated orientation of the fourth lever by an associated arrow being operationally engaged with the crossbow trigger apparatus;

wherein the fourth lever is engaged with a fourth lever spring that biases the fourth lever to the unactuated orientation of the fourth lever;

wherein the third lever adapted to be rotated from the actuated orientation of the third lever to the unactuated orientation of the third lever by cocking an associated bowstring;

wherein the second lever is engaged with a second lever spring that biases the second lever to the unactuated orientation of the second lever;

wherein the first lever is engaged with a first lever spring that biases the first lever to the unactuated orientation of the first lever;

wherein the fourth lever comprises a manual decocking lobe projecting radially from the fourth pivot axis adapted to permit an associated user to selectably move the fourth lever from the unactuated orientation of the fourth lever to the actuated orientation of the fourth lever; and wherein the second lever and the fourth lever contact one another in both the actuated orientation and the unactuated orientation.

2. A method for using a crossbow trigger apparatus comprising:

providing a crossbow trigger apparatus having a housing, a first lever operationally engaged with the housing to pivot about a first pivot axis between an actuated orientation and an unactuated orientation, the first pivot axis being fixed in a first location with respect to the housing, the first lever being elongated to define a first end of the first lever and a second end of the first lever opposite the first end of the first lever, a second lever operationally engaged with the housing to pivot about a second pivot axis between an actuated orientation and an unactuated orientation, the second pivot axis being fixed in a second location with respect to the housing, the second location being offset from the first location, the second lever being elongated to define a first end of the second lever and a second end of the second lever opposite the first end of the second lever, a third lever operationally engaged with the housing to pivot about a third pivot axis between an actuated orientation and an unactuated orientation, the third pivot axis being fixed in a third location with respect to the housing, the third location being offset from the first location, and being offset from the second location, the third lever being elongated and U-shaped to define a first end of the third lever and a second end of the third lever opposite the first end of the third lever, the third lever being adapted, when in the unactuated orientation, to retain an associated cocked bowstring, and when in the actuated orientation, to release an associated cocked bowstring, a fourth lever operationally engaged with the housing to pivot about a fourth pivot axis between an actuated orientation and an unactuated orientation, the fourth pivot axis being fixed in a fourth location with respect to the housing, the fourth location being offset from the first location, being offset from the second location, and being offset from the third location, the fourth lever being elongated to define a first end of the fourth lever and a second end of the fourth lever opposite the first end of the fourth lever, wherein the fourth lever comprises a fourth lever catch adapted to selectably engage the second lever to prevent the second lever from operating to move from the unactuated orientation of the second lever to the actuated orientation of the second lever when the fourth lever is in the unactuated orientation of the fourth lever, wherein the second lever comprises a second lever catch adapted to selectably engage the third lever, and to prevent the third lever from operating to move from the unactuated orientation of the third lever to the actuated orientation of the third lever when the second lever is in the unactuated orientation of the second lever, and wherein the fourth lever is adapted to be moved from the unactuated orientation of the fourth lever to the actuated orientation of the fourth lever by an associated arrow being operationally engaged with the crossbow trigger apparatus;

wherein the fourth lever comprises a manual decocking lobe projecting radially from the fourth pivot axis adapted to permit an associated user to selectably move the fourth lever from the unactuated orientation of the fourth lever to the actuated orientation of the fourth lever;

setting the third lever in the unactuated orientation of the third lever;

retaining an associated cocked bowstring using the third lever in the unactuated orientation;

setting the second lever in the unactuated orientation of the second lever;

using the second lever catch to engage the third lever and prevent the third lever from operating to move from the unactuated orientation of the third lever to the actuated orientation of the third lever;

setting the fourth lever in the unactuated orientation of the fourth lever; and using the fourth lever catch to engage the second lever to prevent the second lever from operating to move from the unactuated orientation of the second lever to the actuated orientation of the second lever; and keeping the second lever and the fourth lever in contact in both the actuated orientation and the unactuated orientation.

3. The method for using a crossbow trigger apparatus of claim 2, further comprising moving the fourth lever from the unactuated orientation of the fourth lever to the actuated orientation of the fourth lever using the decocking lobe thereon, and thereby disengaging the fourth lever catch from the second lever such that the fourth lever catch does not prevent the second lever from operating to move from the unactuated orientation of the second lever to the actuated orientation of the second lever;

setting the first lever in the actuated orientation of the first lever and thereby setting the second lever in the actuated orientation of the second lever, and thereby disengaging the second lever catch from the third lever such that the second lever catch does not prevent the third lever from operating to move from the unactuated orientation of the third lever to the actuated orientation of the third lever;

setting the third lever in the actuated orientation of the third lever; and releasing the associated cocked bowstring.

4. The method for using a crossbow trigger apparatus of claim 2, further comprising, operationally engaging an associated arrow with the crossbow trigger apparatus and thereby moving the fourth lever from the unactuated orientation of the fourth lever to the actuated orientation of the fourth lever, and thereby disengaging the fourth lever catch from the second lever such that the fourth lever catch does not prevent the second lever from operating to move from the unactuated orientation of the second lever to the actuated orientation of the second lever;

setting the first lever in the actuated orientation of the first lever and thereby setting the second lever in the actuated orientation of the second lever, and thereby disengaging the second lever catch from the third lever such that the second lever catch does not prevent the third lever from operating to move from the unactuated orientation of the third lever to the actuated orientation of the third lever;

setting the third lever in the actuated orientation of the third lever; and releasing the associated cocked bowstring.

5. The method for using a crossbow trigger apparatus of claim 2, further comprising firing the associated arrow with the associated cocked bowstring.

* * * * *